US005116570A

United States Patent [19]

Kim et al.

[11] Patent Number: 5,116,570

[45] Date of Patent: May 26, 1992

[54] STAINLESS MARAGING STEEL HAVING HIGH STRENGTH, HIGH TOUGHNESS AND HIGH CORROSION RESISTANCE AND IT'S MANUFACTURING PROCESS

[75] Inventors: Young G. Kim, Seoul; Soon H. Hong, Daejon; Jin I. Seok, Kyungsangbuk-do, all of Rep. of Korea

[73] Assignee: Korea Advanced Institute of Science and Technology, Daejeon, Rep. of Korea

[21] Appl. No.: 758,637

[22] Filed: Sep. 12, 1991

[30] Foreign Application Priority Data

Sep. 21, 1990 [KR] Rep. of Korea ..... 15019/1990

[51] Int. Cl.[5] ..... C22C 38/44; C22C 38/50

[52] U.S. Cl. ..... 420/54; 148/326; 148/542; 420/57; 420/63

[58] Field of Search ..... 148/326, 327, 328, 12.7 R, 148/2; 420/57, 54, 63

[56] References Cited

U.S. PATENT DOCUMENTS

| | | | |
|---|---|---|---|
| 3,723,196 | 3/1973 | Murphy et al. | 148/328 |
| 4,871,511 | 10/1989 | Smith, Jr. et al. | 148/328 |

FOREIGN PATENT DOCUMENTS

| | | | |
|---|---|---|---|
| 664462 | 6/1963 | Canada | 148/328 |
| 41-3681 | 3/1966 | Japan | 148/328 |

*Primary Examiner*—Deborah Yee

[57] ABSTRACT

A stainless maraging steel and process having high strength, high toughness and high corrosion resistance. The alloy consists of from 8 to 12% by weight Cr, 7 to 12% by weight Ni, 2 to 6% by weight W, 0.1 to 0.5% by weight Al, 0.1 to 0.4% by weight Ti, and the balance iron.

2 Claims, No Drawings

STAINLESS MARAGING STEEL HAVING HIGH STRENGTH, HIGH TOUGHNESS AND HIGH CORROSION RESISTANCE AND IT'S MANUFACTURING PROCESS

FIELD OF THE INVENTION

This invention relates to the stainless maraging steel with high strength, high toughness and high corrosion resistance and it's manufacturing process.

BACKGROUND OF THE INVENTION

In general, the maraging steels have been used in many fields such as dies, rocket motor cases, load cells and gears, etc., which require high strength with high toughness. The conventional alloy system is 18% Ni—Co—Mo maraging steel of U.K. Pat. 936557. But, the Co and Mo, which are expensive alloying elements, increase the fabrication cost of maraging steels. Especially, the price of the Co, which is a strategic material, has increased rapidly due to the deficiency of supply in world market. Therefore, the demand for maraging steel of new composition has been increased in order to substitute the present alloys.

The Co-free 20–25% Ni maraging steel of U.K. Pat. 948354 was developed, but this steel has difficulty in commercialization due to poor toughness. The 20% Ni and 25% Ni maraging steels of France Pat. 2127799 have improved tensile strength to about 130 kg/mm$^2$ and elongation to about 9%, however, they have poor ductility and the corrosion resistance was not considered. The Co-free maraging steel of Korean Pat. Publication No. 87-2074 is known, but this steel include Mo, which is an expensive alloying elements, and have poor ductility without considering corrosion resistance. On the other hand, the 18% Ni maraging steel has higher resistance to stress corrosion cracking and hydrogen embrittlement compared with the medium carbon low alloy steels, while, if it is used in corrosive atmosphere or used as part contacting with water, then the protective surface treatment is necessary. Therefore, the stainless maraging steel(IN-736), which have improved toughness and corrosion resistance instead of lowered strength compared with conventional maraging steels, was developed, however, this include Mo and the corrosion resistance is not good. While, the Co-and MO-free maraging steel having high strength and high toughness was developed as Korean Pat. Publication No. 90-402 by one of our inventors, but this steel has poor ductility and corrosion resistance.

SUMMARY OF THE INVENTION

The object of present invention is to develop a Co-free maraging steel, with the substitution of W for Mo, having improved ductility and corrosion resistance without deteriorating strength and toughness. The invented new stainless maraging steel contains, in weight percent, 8% to 12% chromium, 7% to 12% nickel, 2% to 6% tungsten, 0.1% to 0.5% aluminium, 0.1% to 0.4% titanium and balance essentially iron.

The invented stainless maraging steel, which has above composition, is manufactured as following process. The electrolytic iron Ni, Cr, Al, Ti with 99.9% purity and W powder with 99.95% purity are used for melting. Thereafter, Fe, Ni and Cr are melted first in a vacuum induction furnace or electrical furnace and then alloying elements of W, Ti and Al are added. The melt is obtained as having composition, in weight percent, of 8% to 12% Cr, 7% to 12% Ni, 2% to 6% W, 0.1% to 5.0% Al and 0.1% to 0.4% Ti. This molten melt is cast into a mould to make ingots. The cast ingots are homogenized at 1200°–1250° C. for 1–3 hours, and then hot-forged and hot-rolled at 1200°–1250° C. The hot-rolled plates are solution-treated at 800°–1000° C. for 1–3 hours followed by air cooling to get uniform martensite structure. The fine intermetallic compounds are precipitated in martensitic matrix through aging at 400°–600° C. for 1–25 hours.

DETAILED DESCRIPTION OF THE INVENTION

The invented new stainless maraging steel contains, in weight percent, 8% to 12% chromium, 7% to 12% nickel, 2% to 6% tungsten, 0.1% to 0.5% aluminium, 0.1% to 0.4% titanium and the balance essentially iron. The reason for the limitation of composition range of the invented steel is as follows. Chromium (8–12 weight percent) is added to improve the corrosion resistance. If Cr amount is either less than 8% or more than 12%, the uniform martensite structure is not formed as the matrix of stainless maraging steel. Nickel (7–12 weight percent) is necessary to form uniform martensitic matrix. Ni amounts was lowered compared with the 18Ni maraging steel and the total amount of Ni and Cr was controlled. Tungsten (2–6 weight percent) is added to increase the strength by forming stable precipitate or by solid solution hardening effect at high temperature. However, as the ductility and toughness decrease with increasing W content, the desirable content of W is selected. Aluminium (0.1–0.5 weight percent) increases the strength, however, the ductility decreases with increasing Al content. Titanium (0.1–0.4 weight percent) increases the strength by forming intermetallic compound during aging treatment, and refines by trapping residual carbon. However, as the toughness decreases with increasing Ti content, the desirable content of Ti is selected.

The invented stainless maraging steel, which has above composition, is manufactured as following processes. The electrolytic iron Ni, Cr, Al, Ti with 99.9% purity and W powder with 99.95% purity are used for melting. Thereafter, Fe, Ni and Cr are melted first in a vacuum induction furnace or electrical furnace and then alloying elements of W, Ti and Al are added. The melt is obtained as having composition, in weight percent, of 8% to 12% Cr, 7% to 12% Ni, 2% to 6% W, 0.1% to 0.5% Al and 0.1% to 0.4% Ti. This molten melt is cast into a mould to make ingots. The cast ingots are homogenized at 1200°–1250° C. for 1–3 hours, and then hot-forged and hot-rolled at 1200°–1250° C. The hot-rolled plates are solution-treated at 800°–1000° C. for 1–3 hours followed by air cooling to get uniform martensite structure. The fine intermetallic compounds are precipitated in martensitic matrix through aging at 400°–600° C. for 1–25 hours.

Some examples are explained as follows.

EXAMPLE 1

The invented five alloys (No 1–No. 5) listed in Table 1 were melted in an induction furnace and cast into mould to make ingots.

The cast ingots were homogenized at 1250° C. for 1 hour and then followed by hot-forging and hot-rolling. The standard tensile specimens and Charpy V-Notch impact specimens were machined from the hot-rolled plates were solution-treated at 830° C. for 1 hour followed by aging treatment at 480° C. for 3 hours.

The physical properties at room temperature and high temperature are reported in Table 2 and 3, respectively.

TABLE 1

Chemical compositions of stainless maraging steels.

| Alloy | | Sample | Chemical composition (weight percent) Fe | Cr | Ni | Mo | W | Al | Ti |
|---|---|---|---|---|---|---|---|---|---|
| Reference | | No. 1 | 80.2 | 10.8 | 10.3 | — | — | 0.21 | — |
| Maraging Steel | | No. 2 | 79.95 | 10.7 | 10.6 | — | — | 0.21 | 0.31 |
| Invented | | No. 3 | 77.95 | 11.3 | 8.64 | — | 1.84 | 0.39 | 0.27 |
| Maraging Steel | | No. 4 | 75.95 | 11.2 | 9.61 | — | 4.0 | 0.39 | 0.26 |
| Conventional | IN-736 | No. 5 | 77.95 | 10.7 | 9.46 | 2.45 | — | 0.46 | 0.28 |
| Maraging Steel | Korean Pat. Pub. No. 90-402 | No. 6 | 78.0 | — | 18.5 | — | 3.0 | 0.1 | 1.4 |
| | Korean Pat. Pub. No. 87-2074 | No. 7 | 77.1 | — | 18.1 | 2.2 | — | 0.1 | 2.5 |

TABLE 2

Physical properties of stainless maraging steels at room temperature

| Alloy | | Sample | Yield Strength (MPa) | Tensile Strength (MPa) | Elongation (%) |
|---|---|---|---|---|---|
| Reference | | No. 1 | 882 | 897 | 22.7 |
| Maraging Steel | | No. 2 | 1198 | 1299 | 16.3 |
| Invented | | No. 3 | 1311 | 1375 | 14.4 |
| Maraging Steel | | No. 4 | 1313 | 1378 | 13.4 |
| Con-ventional | IN-736 | No. 5 | 1309 | 1370 | 12.8 |
| Maraging Steel | Korean Pat. Pub No. 90-402 | No. 6 | 1600 | 1650 | 8.0 |
| | Korean Pat. Pub No. 87-2074 | No. 7 | 2006 | 2130 | 5.0 |

The yield strength and tensile strength of alloy No. 1, which does not contain Ti and W, are lower than those of other alloys (alloy No. 2–5), while the elongation of alloy No. 1 is higher than other alloys as shown in Table 2 and 3. This results indicated that the alloy No. 1 is not precipitation hardened.

The yield strength, tensile strength and elongation of the invented alloys (No. 3 and 4) are comparable to those of IN-736 (No. 5). On the other hand, the yield strength and tensile strength of the 18% Ni maraging steel (No 6 and No. 7) were higher than those of invented alloys, while the elongation was much lower than that of invented alloys.

TABLE 3

Physical properties of stainless maraging steels tested at elevated temperature of 250° C.

| Alloy | Yield Strength (MPa) | Tensile Strength (MPa) | Elongation (%) | Specimen Shape |
|---|---|---|---|---|
| No. 1 | 696 | 745 | 18.3 | R |
| No. 2 | 1052 | 1136 | 14.6 | R |
| No. 3 | 1077 | 1143 | 7.1 | P |
| No. 4 | 1085 | 1155 | 7.2 | P |
| No. 5 | 1055 | 1139 | 7.4 | P |

P: Plate, R: Round Bar

The tensile properties do not vary much with varying W content. This result indicates that the tungsten does not form precipitates of intermetallic compound, but influences on the strength through solid solution hardening. The yield strength and tensile strength at high temperature, as shown in Table 3, are lower than those at room temperature. This result was due to the softening by annihilation of dislocations at high temperature.

TABLE 4

Charpy impact energy of stainless maraging steels.

| Alloy | Charpy impact energy (Joule) |
|---|---|
| No. 1 | 311 |
| No. 2 | 80 |
| No. 3 | 78 |
| No. 4 | 55 |
| No. 5 | 54 |

Table 4 shows the Charpy impact energys of stainless maraging alloys at room temperature. The Charpy impact energy of alloy No. 1, which does not include Ti and W, is quite high because it does not contain any precipitates is soft martensitic matrix. The Charpy impact energy of the invented alloy (No. 4), with substitution of 4% W for Mo, was nearly identical to that of "IN-736" (No. 5).

TABLE 5

Fracture toughness ($K_{IC}$) and critical stress intensity factor for stress corrosion cracking ($K_{ISCC}$) of stainless maraging steels. unit: MPa · $m^2$

| Alloy | Fracture Toughness $K_{IC}$ | $K_{ISCC}$ |
|---|---|---|
| No. 3 | 140.7 | 90.5 |
| No. 4 | 134.6 | 91.4 |
| No. 5 | 110.2 | 79.4 |

As shown in Table 5, the fracture toughness and critical stress intensity factor for stress corrosion cracking of the invented alloys (No. 3 and No. 4) was higher than that of alloy No. 5 (IN-736). The variation of physical properties with varying solution treatment temperature is shown in Table 6.

TABLE 6

Physical properties after solution-treated at temperatures range from 800 to 1000° C.

| Temperature (°C.) | Yield Strength (MPa) | Tensile Strength (MPa) | Elongation (%) | Charpy impact energy (Joule) |
|---|---|---|---|---|
| 800 | 900 | 964 | 16.9 | 182 |
| 850 | 864 | 950 | 16.9 | 190 |
| 900 | 861 | 945 | 17.1 | 194 |
| 950 | 800 | 897 | 17.2 | 200 |

TABLE 6-continued

| Physical properties after solution-treated at temperatures range from 800 to 1000° C. | | | | |
|---|---|---|---|---|
| Temperature (°C.) | Yield Strength (MPa) | Tensile Strength (MPa) | Elongation (%) | Charpy impact energy (Joule) |
| 1000 | 800 | 896 | 17.4 | 200 |

The yield strength and tensile strength decrease as the solution treatment temperature increasing up to certain temperature and remain almost constant above that, while, the elongation shows nearly same value for the entire range of solution treatment temperature. On the other hand, the Charpy impact energy remains almost constant with varying solution treatment temperature above 950° C. This results are due to the presence of the high temperature precipitates of the Laves phase formed during solution treatment if the composition is above the solubility limit.

As shown in above results, the invented alloy, which does not contain expensive alloying elements such as Co and Mo, exhibits the comparable physical properties with much higher corrosion resistance "IN-736" maraging steel.

What is claimed is:

1. A stainless maraging steel having high strength, high toughness and high corrosion resistance consisting of 8% to 12% by weight Cr, 7% to 12% by weight Ni, 2% to 6% by weight W, 0.1 to 0.5% by weight Al, 0.1 to 0.4% by weight Ti and the balance iron.

2. A method of manufacturing a stainless maraging steel having strength, high toughness and high corrosion resistance characteristics, said alloy consisting the product of a process comprising:

(A) melting an alloy consisting of 8 to 12% by weight Cr, 7 to 12% by weight Ni, 2 to 6% by weight W, 0.1 to 0.5% by weight Al, 0.1 to 0.4% by weight Ti and the balance iron, in a melting furnace using electrolytic iron, Ni, Cr, Al, Ti and W powder with high purity, and cast into mould to make, ingots.;

(B) the cast ingots were homogenized at 1200° to 1250° C. for 1 to 3 hour, and then followed hot-forging and hot-rolling; and (C) the hot-rolled plates were solution-treated at 800° to 1000° C. for 1 to 3 hours, and then aging at 400° to 600°) C. for 1 to 25 hours.

* * * * *